United States Patent [19]

Beisel et al.

[11] Patent Number: 4,658,724

[45] Date of Patent: Apr. 21, 1987

[54] DEVICE FOR TRANSFERRING INK TO AN INKING UNIT OF A PRINTING MACHINE

[75] Inventors: Hermann Beisel, Walldorf; Karl-Heinz Seefried, Zuzenhausen, both of Fed. Rep. of Germany

[73] Assignee: Heidelgerger Druckmaschinen AG, Heidelberg, Fed. Rep. of Germany

[21] Appl. No.: 779,143

[22] Filed: Sep. 23, 1985

[30] Foreign Application Priority Data

Sep. 21, 1984 [DE] Fed. Rep. of Germany ..... 3434646

[51] Int. Cl.[4] ..... B41F 31/00

[52] U.S. Cl. ..... 101/351; 101/352; 101/349

[58] Field of Search ..... 101/348, 351, 352, 357, 101/358, 361, 362, 349

[56] References Cited

U.S. PATENT DOCUMENTS

| | | | |
|---|---|---|---|
| 3,757,689 | 9/1973 | Koch et al. | 101/352 X |
| 4,385,559 | 5/1983 | Jarach | 101/352 X |

FOREIGN PATENT DOCUMENTS

| | | | |
|---|---|---|---|
| 579207 | 7/1959 | Canada | 101/351 |
| 877903 | 7/1949 | Fed. Rep. of Germany | 101/358 |
| 1270048 | 6/1968 | Fed. Rep. of Germany | 101/351 |
| 3327872 | 5/1984 | Fed. Rep. of Germany | 101/351 |
| 1073166 | 9/1954 | France | 101/351 |
| 631661 | 11/1949 | United Kingdom | 101/358 |

*Primary Examiner*—Edgar S. Burr
*Assistant Examiner*—James R. McDaniel
*Attorney, Agent, or Firm*—Herbert L. Lerner; Laurence A. Greenberg

[57] ABSTRACT

An ink duct in a printing machine having an ink duct roller, an axially reciprocating distributor roller, a vibrating lifter roller secured via a lever to a floating spindle, and a control cam for transmitting an oscillating movement to the lifter roller in transverse direction thereof between the ink duct roller and the distributor roller includes additional control cam means for transmitting an axial reciprocating movement to the vibrating lifter roller in synchronism with the axial reciprocating motion of the distributor roller, the lifter roller being alternately in contact with the ink duct roller and the distributor roller for transferring ink from the ink duct roller to the distributor roller, the additional control cam means being constructed so as to transmit the axial reciprocating movement of the vibrating lifter in opposite direction to the axial reciprocating movement of the distributor roller when the vibrating lifter is in contact with the distributor roller.

3 Claims, 2 Drawing Figures

DEVICE FOR TRANSFERRING INK TO AN INKING UNIT OF A PRINTING MACHINE

Figure 1:
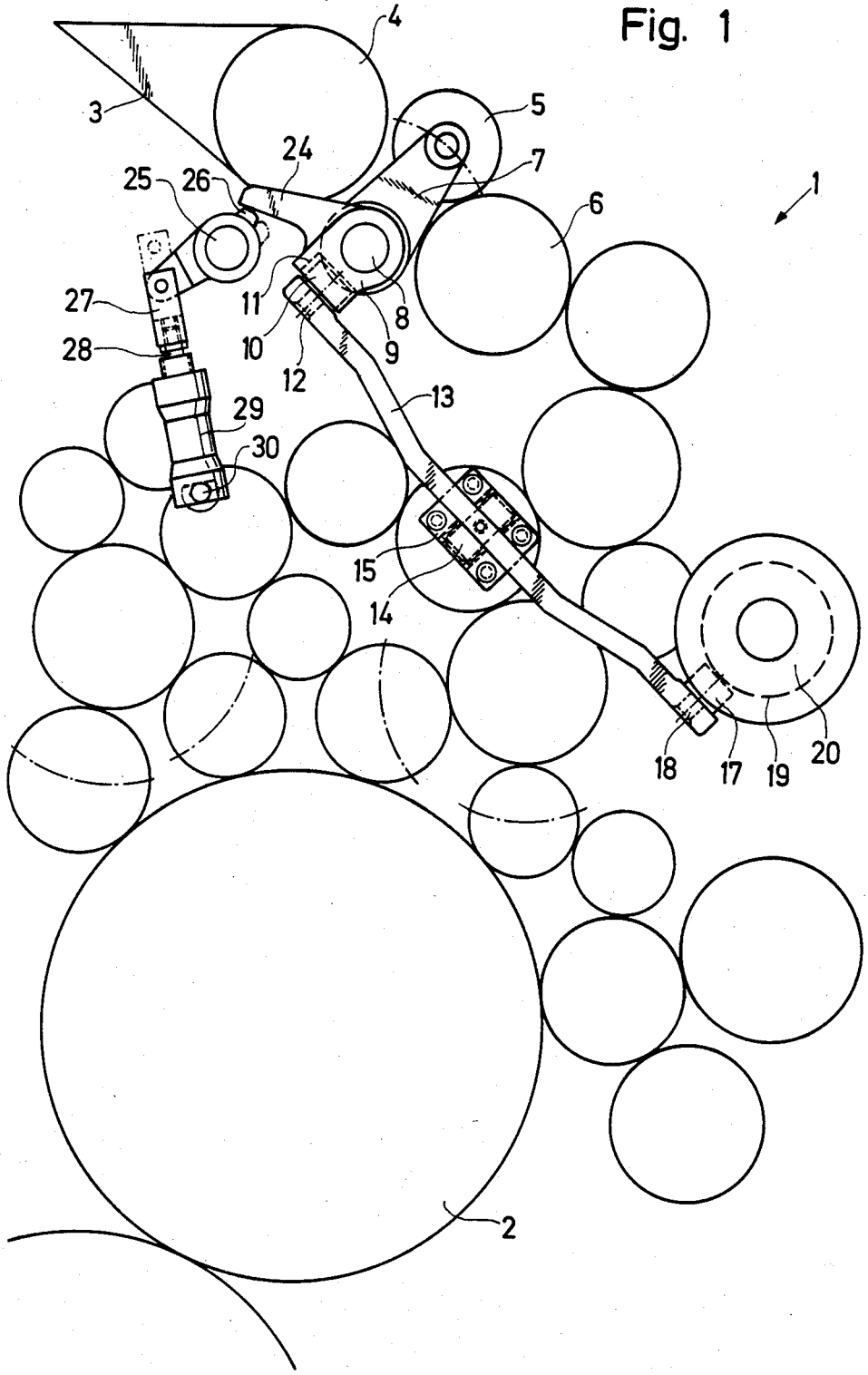

The invention relates to a device for transferring ink to an inking unit of a printing machine and, more particularly, to an ink duct having an ink duct roller, an axially reciprocating distributor roller, a vibrating lifter roller secured via a lever to a floating spindle, and a control cam for transmitting an oscillating movement to the lifter roller in transverse direction thereof between the ink duct roller and the distributor roller.

A conventional construction of this type in German Published Prosecuted Application (DE-AS) No. 28 19 257 provides in an inking unit, a lifter or vibrating roller which performs an oscillating movement between an ink duct roller and a brayer or distributor roller and is mounted on a floating spindle. In the illustrated construction of this German application, the control for the reciprocating movements is in the form of a control cam which transmits the movement via a roller lever. The oscillating motion can be stopped by means of a manually operated mechanism so that no ink can enter the inking device when the paper feed is stopped or also when printing has ceased.

This known construction is operated purely manually and transfers an ink stripe first as it is fed from the ink duct roller without utilizing the transfer to improve the ink guidance, a fact which has a negative effect on subsequent production of a uniform ink film.

Starting from this state of the art, it is an object of the invention to provide improved ink preparation in an inking unit and, in fact, to achieve this as early as possible in vicinity of the ink duct in order to improve the starting base for the inking unit per se.

With the foregoing and other objects in view, there is provided, in accordance with the invention, an ink duct in a printing machine having an ink duct roller, an axially reciprocating distributor roller, a vibrating lifter roller secured via a lever to a floating spindle, and a control cam for transmitting an oscillating movement to the lifter roller in transverse direction thereof between the ink duct roller and the distributor roller, comprising additional control cam means for transmitting an axial reciprocating movement to the vibrating lifter roller in synchronism with the axial reciprocating motion of the distributor roller, the lifter roller being alternately in contact with the ink duct roller and the distributor roller for transferring ink from the ink duct roller to the distributor roller, the additional control cam means being constructed so as to transmit the axial reciprocating movement of the vibrating lifter in opposite direction to the axial reciprocating movement of the distributor roller when the vibrating lifter is in contact with the distributor roller.

The ink firm to be transferred is already positively influenced by this additional spread or distributing motion between the lifter or dancing roller and the ink duct roller or between the lifter roller and the first brayer distributor roller. Between the lifter roller and the distributor roller, the spreading or distributing motion i.e. the stretch or course over which the rollers are shifted against one another when in contact, is doubled without increasing the reciprocating stroke of the one or the other roller.

In accordance with another feature of the invention, there is provided a sliding bushing formed with a slot and secured to the floating spindle, a lever mounted on a side frame of the printing machine and carrying a roll at a free end thereof, the roll engaging in the slot formed in the sliding bushing, the lever carrying a follower roll at another free end thereof located opposite the roll engaging in the slot, the follower roll being in operative engagement with the additional control cam means.

In accordance with a concomitant feature of the invention, the additional control cam means are a closed control cam of a cam disc wherein the follower roll rollingly engages.

Other features which are considered as characteristic for the invention are set forth in the appended claims.

Although the invention is illustrated and described herein as embodied in a device for transferring ink to an inking unit of a printing machine, it is nevertheless not intended to be limited to the details shown, since various modifications and structural changes may be made therein without departing from the spirit of the invention and within the scope and range of equivalents of the claims.

Figure 2:
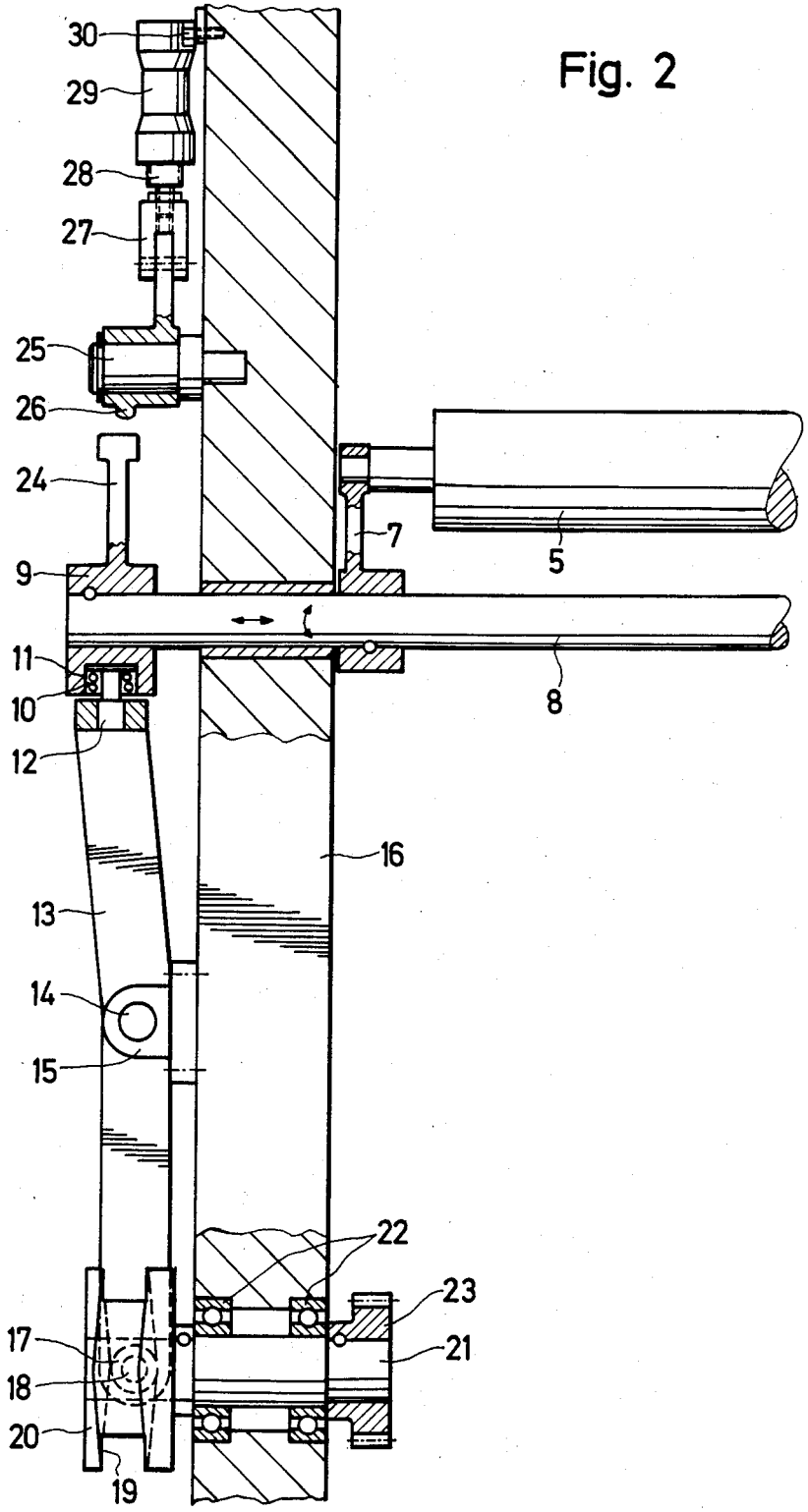

The construction and method of operation of the invention, however, together with additional objects and advantages thereof will be best understood from the following description of specific embodiments when read in connection with the accompanying drawings, in which:

FIG. 1 is a diagrammatic side elevational view of an inking unit of a printing machine embodying the device according to the invention; and FIG. 2 is a fragmentary plan view, partly in section, of FIG. 1.

Referring now to the drawings and first, particularly, to FIG. 1 thereof, there is shown an inking unit 1 and a plate cylinder 2 having a printing plate which is inked thereby in a conventional manner. The ink required for printing is provided in an ink duct 3 and is transferred via an ink duct roller 4, a lifting or vibrating roller 5 and a conventionally axially recpirocating brayer or distributor roller 6 into the inking unit 1. Due to the oscillating motion of the lifting or vibrating roller 5, an ink stripe is transferred from the ink duct roller 4 to the reciprocating distributor roller 6, and is then processed in the inking unit into a uniform ink film. The lifting roller 5 is mounted on both sides on levers 7 which, in turn, are secured to a floating spindle 8. The floating spindle 8 and, therewith, the lifting roller 5 receive the osicllating motion thereof between the ink duct roller 4 and the reciprocating distributing roller 6 from a non-illustrated transmission system or gear mechanism.

A sliding bushing 9 formed with a slot 11 for holding therein a roller 10 is mounted on the floating spindle 8. The roller 10 is secured by means of a pin 12 to a lever 13 which is mounted on a machine side frame 16 by means of a bearing pin 18 and a self-aligning bearing 15. A roller 17 is mounted by means of a pin 18 on the end of the lever 13 located opposite to the end thereof to which the roller 10 is secured. The roller 17 engages in an additional closed control cam 19 of a control cam 20 so that, during rotation of the control cam 20, an axial reciprocating motion is transferred via the lever 13 to the floating spindle 8. In this way, the lifting roller 5 is reciprocated and simultaneously performs an independent oscillatory movement.

As shown in FIG. 2, the control cam 20 is mounted so that it can rotate on the spindle 21 which, in turn, is mounted by means of a bearing 22 in the machine side frame 16. The drive is provided by means of a spur gear 23 at such a speed that the axial oscillatory or reciprocating movement of the lifting roller 5 takes place in synchronism with the conventional oscillator or reciprocating movement of the distributor roller 6. When the lifting roller 5 engages the distributor roller 6, the direction of movement of the lifting roller 5 is in the opposite direction. In this way, double the spreading or distributing path or course is produced between the two rollers.

We claim:

1. Ink duct in a printing machine having an ink duct roller, an axially reciprocating distributor roller, a vibrating lifter roller secured at both ends thereof via respective levers to a floating spindle, and a control cam for transmitting an oscillating movement to the floating spindle and the lifter roller in transverse direction thereof between the ink duct roller and the distributor roller, comprising additional control cam means for transmitting an axial reciprocating movement to the floating spindle and the vibrating lifter roller in synchronism with the axial reciprocating motion of the distributor roller, the lifter roller being alternately in contact with the ink duct roller and the distributor roller for transferring ink from the ink duct roller to the distributor roller, said additional control cam means being constructed so as to transmit said axial reciprocating movement of the vibrating lifter in opposite direction to the axial reciprocating movement of the distributor roller when the vibrating lifter is in contact with the distributor roller.

2. Ink duct according to claim 1, including a sliding bushing formed with a slot and secured to the floating spindle, a lever mounted on a side frame of the printing machine and carrying a roll at a free end thereof, said roll engaging in said slot formed in said sliding bushing, said lever carrying a follower roll at another free end thereof located opposite said roll engaging in said slot, said follower roll being in operative engagement with said additional control cam means.

3. Ink duct according to claim 2, wherein said additional control cam means are a closed control cam of a cam disc wherein said follower roll rollingly engages.

* * * * *